US006240698B1

(12) United States Patent
Chung

(10) Patent No.: US 6,240,698 B1
(45) Date of Patent: Jun. 5, 2001

(54) COMPOSITE BALUSTER

(76) Inventor: Pei-Chiang Chung, No. 10, Lane 360, Chung-Hua-I Rd., Tan-Tzu, Hsiang, Taichung Hsien (TW)

( * ) Notice: Subject to any disclaimer, the term of this patent is extended or adjusted under 35 U.S.C. 154(b) by 0 days.

(21) Appl. No.: 09/490,458

(22) Filed: Jan. 25, 2000

(51) Int. Cl.[7] ..... E04C 3/30
(52) U.S. Cl. ..... 52/720.2; 52/720.1; 52/736.3
(58) Field of Search ..... 52/309.15, 736.3, 52/720.2; 249/143; 425/84

(56) References Cited

U.S. PATENT DOCUMENTS 4,035,978 * 7/1977 Bajorek et al. ..... 52/727
5,035,401 * 7/1991 Solter ..... 256/19
5,568,709 * 10/1996 Steckler ..... 52/309.8
5,626,331 * 5/1997 Erwin ..... 256/59

* cited by examiner

*Primary Examiner*—Beth A. Stephan
*Assistant Examiner*—Pat J. Chavez
(74) *Attorney, Agent, or Firm*—Fulwider Patton Lee & Utecht, LLP

(57) ABSTRACT

A composite baluster includes an elongated core made of wood, and a plastic outer shell molded over and enclosing the core. A bottom end of the core projects outward and downward from a bottom end of the outer shell. A wooden end piece is connected to and covers the bottom ends of the core and outer shell. The end piece has a top end face recessed to form a cavity for receiving the bottom end of the core. The top end face of the end piece abuts against the bottom end of the outer shell.

5 Claims, 3 Drawing Sheets

COMPOSITE BALUSTER

BACKGROUND OF THE INVENTION

1. Field of the Invention

The invention relates to the construction of a baluster, more particularly to the construction of a composite baluster.

2. Description of the Related Art

Conventional wooden staircase balusters are generally formed as a rod which is provided with a pleasing outline for aesthetic purposes. As shown in FIG. 1, a typical wooden baluster 1 includes an upper tapered section 101, a neck 102, a lower section 103 of rectangular cross-section, and a tenon 104 formed at a bottom end of the lower section 103. In setting up the baluster 1, the top end of the upper tapered section 101 is embedded into a top stair-rail, and the tenon 104 is fitted in a hole in the floor of a staircase and is nailed securely thereat.

However, the known wooden baluster 1 has the following disadvantages:

1. A considerable amount of wood is consumed in manufacturing the wooden baluster 1, and a lot of waste is produced during the processing of wood.

2. As wood is not sufficiently strong, the wooden baluster 1 is susceptible to damage upon impact and is prone to crack and deform when subjected to varying weather.

3. Although the upper tapered section 101 and the neck section 102 of the wooden baluster 1 may be machined via a lathe machine, the lower section 103 must be formed by using a planing machine. Therefore, different processing operations have to be performed to finish the entire profile of the wooden baluster 1, thus increasing the complexity of the manufacturing process.

SUMMARY OF THE INVENTION

An object of the present invention is to provide a composite baluster which has a strong construction and which can be produced via a simplified process.

According to the present invention, a composite baluster includes an elongated core made of wood and having a bottom end, and a plastic outer shell molded over and enclosing the core. The bottom end of the core projects outward and downward from a bottom end of the outer shell. A wooden end piece is connected to and covers the bottom ends of the core and outer shell. The end piece has a top end face recessed to form a cavity for receiving the bottom end of the core. The top end face abuts against the bottom end of the outer shell.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
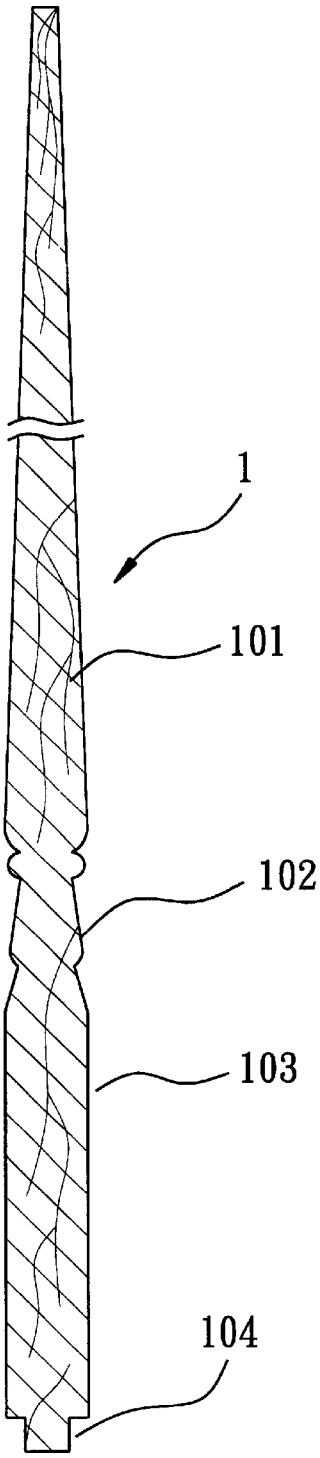
FIG. 1 PRIOR ART
FIG. 1 is a sectional view of a conventional baluster.
Figure 2:
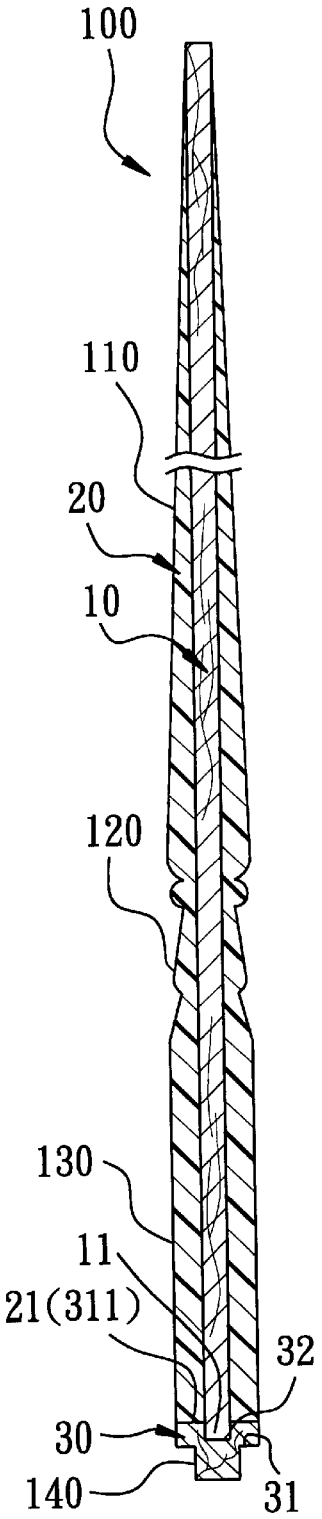
FIG. 2 is a perspective view of a composite baluster embodying the present invention.
Figure 3:
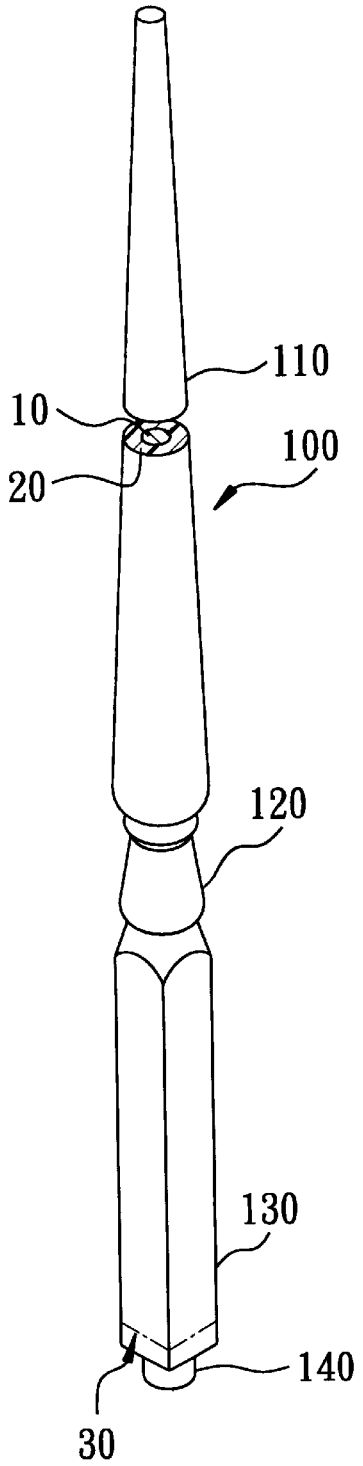
FIG. 3 is a sectional view of the composite baluster of FIG. 2.

Referring to FIGS. 2 and 3, a composite baluster 100 embodying the present invention is shown to include a wooden core 10, a plastic outer shell 20, and a wooden end piece 30.

The core 10 is formed as a rod by a wood-forming process and may be made from timber or plywood. The cross-section of the core 10 may be circular and polygonal.

The plastic outer shell 20 is made from an unsaturated resin and a curing agent and is molded over the core 10. The outer shell 20 includes an upwardly tapered upper section 110, a neck section 120 below said upper section 110, and a lower section 130 of rectangular cross-section below the neck section 120. The plastic outer shell 20 has an outer cross-section which is gradually increased downward from a top end of the upper section 110 and which is reduced from the upper section 110 to the neck section 120 and is then increased from the neck section 120 to the lower section 130. A bottom end 11 of the core 10 projects outward and downward from a bottom end 21 of the lower section 130.

The end piece 30 is made of wood and has a bottom end 31 formed with a tenon 140 of substantially circular cross-section, and a top end face 311 which is recessed to form a cavity 32 for receiving snugly the exposed bottom end 11 of the core 10. When the end piece 30 is pressed against the bottom end 11 of the core 10 and the bottom end 21 of the lower section 130, the bottom end 11 of the core 10 is fitted in the cavity 32, and the top end face 311 of the end piece 30 abuts against the bottom end 21 of the lower section 130.

With the aforesaid construction, the composite baluster 100 not only possesses the toughness and flexibility of wood but also exhibits high strength and nondeformable characteristics of the unsaturated resin. In addition, the baluster 100 provides resistance to weather and cracking. As the end piece 30 is made of wood, it can be nailed on a floor without producing cracks.

The composite baluster 100 can be fabricated as follows: Firstly, the core 10 is formed as a straight rod by a wood-working process. Then, the core 10 is placed in a mold with a mold cavity (not shown) having a shape conforming to that of the outer shell 20. The mold is vertically arranged with a portion corresponding to the lower section 130 being disposed upward and with another portion corresponding to the upper section 110 being disposed downward. An unsaturated resin containing a curing agent is poured into the mold cavity from the top of the mold. A portion of the core 10 is left exposed from the resin adjacent to the top of the mold. After the resin is cured, the mold is removed. The end piece 30 is attached to the core 10 and the outer shell 20 by receiving the exposed portion of the core 10 in the cavity 32 of the end piece 30 and by bonding adhesively the exposed portion to the end piece 30. After painting the outer shell 20 and the end piece 30, the fabrication of the baluster 100 is completed.

The composite baluster 100 provides the advantage of reducing the consumption of wood and avoiding the wasting of wooden material. Due to the presence of the plastic outer shell 20, the composite baluster 100 possesses a strong construction which can prevent damage and deformation upon impact and which provides resistance to cracking and deformation due to varying weather. The wooden core 10 of the composite baluster 10 provides a measure of toughness and flexibility. Moreover, as the outline of the composite baluster 100 is formed via a molding process, the need to perform different wood-working operations, which are required in the processing of the conventional wooden baluster, can be eliminated. The manufacturing process of the composite baluster 100 is thus simple as compared to that of the conventional wooden baluster.

Figure 4:
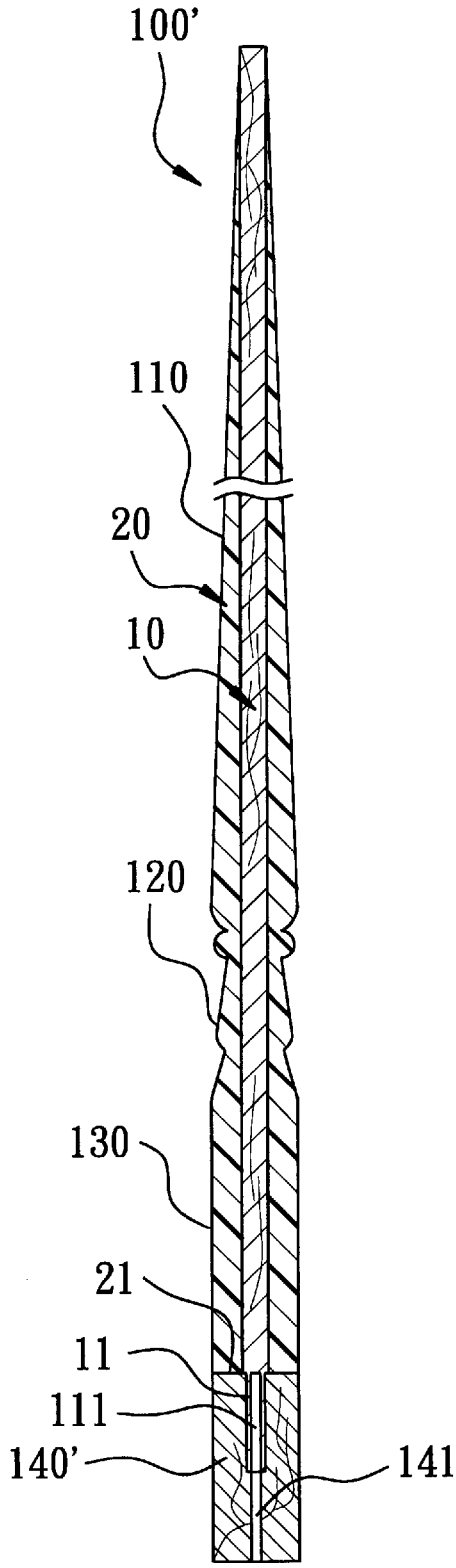
FIG. 4 is a sectional view showing another embodiment of the composite baluster according to the present invention.

Another embodiment of the composite baluster according to the present invention is shown at 100' in FIG. 4. The composite baluster 100' differs from the composite baluster 100 of the previous embodiment in that the end piece 140' has no tenon at its bottom end and that the bottom end 11 of the core 10 and the end piece 140' are bored to form aligned holes 111 and 141 so that the composite baluster 100' can be screwed to a floor via a locking screw (not shown) which will be inserted into the holes 11 and 141 through the floor.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What I claim is:

1. A composite baluster comprising:

an elongated core made of wood and having a bottom end; and a plastic outer shell molded over and enclosing said core, said bottom end of said core projecting outward and downward from a bottom end of said outer shell; and a wooden end piece connected to and covering said bottom ends of said core and outer shell, said end piece having a top end face recessed to form a cavity for receiving said bottom end of said core, said top end face abutting against said bottom end of said outer shell.

2. The composite baluster as claimed in claim 1, wherein said plastic outer shell includes an upwardly tapered upper section, a neck section below said tapered upper section, and a lower section below said neck section, said outer shell having an outer cross-section which is gradually increased downward from a top end of said upper section and which is reduced from said upper section to said neck section and is then increased from said neck section to said lower section.

3. The composite baluster as claimed in claim 1, wherein said end piece is bonded adhesively to said bottom ends of said core and outer shell.

4. The composite baluster as claimed in claim 1, wherein said end piece further has a downwardly projecting tenon formed at a bottom end of said end piece.

5. The composite baluster as claimed in claim 1, wherein said bottom end of said core and said end piece are bored to form therein aligned holes which are adapted to receive a locking screw.

* * * * *